US010048040B1

(12) United States Patent
Ratliff

(10) Patent No.: US 10,048,040 B1
(45) Date of Patent: Aug. 14, 2018

(54) ADJUSTABLE ATTACHMENT SYSTEM FOR WEAPON ACCESSORIES

(71) Applicant: RATLIFF TRADITIONS LLC, Shiner, TX (US)

(72) Inventor: Derrick Ratliff, College Station, TX (US)

(73) Assignee: RATLIFF TRADITIONS, LLC, Shiner, TX (US)

( * ) Notice: Subject to any disclaimer, the term of this patent is extended or adjusted under 35 U.S.C. 154(b) by 0 days.

(21) Appl. No.: 15/400,578

(22) Filed: Jan. 6, 2017

Related U.S. Application Data

(60) Provisional application No. 62/275,553, filed on Jan. 6, 2016.

(51) Int. Cl.
*F41G 11/00* (2006.01)

(52) U.S. Cl.
CPC ..... *F41G 11/003* (2013.01)

(58) Field of Classification Search
CPC ..... F41G 11/003
USPC ..... 42/124–128
See application file for complete search history.

(56) References Cited

U.S. PATENT DOCUMENTS 3,579,840 A * 5/1971 Heinzel ..... F41G 11/003 42/127
3,750,318 A 8/1973 Burris
5,315,781 A 5/1994 Beisner
6,705,038 B2 * 3/2004 Davenport ..... F41G 11/004 42/127
7,140,143 B1 11/2006 Ivey
8,567,105 B1 * 10/2013 Bobro ..... F41G 11/003 42/127
2008/0216380 A1 * 9/2008 Teetzel ..... F41G 11/003 42/127
2010/0236124 A1 * 9/2010 Troy ..... F41A 35/02 42/90
2012/0085013 A1 * 4/2012 Cahill ..... F41A 35/02 42/96

(Continued)

OTHER PUBLICATIONS

Nightforce Anti-Cant Device Top Ring Bubble Level for Nightforce Steel, Unimount and Direct Mount Rings 30mm Matte [retrieved from Internet on Jun. 23, 2017 using <URL: https://www.midwayusa.com/product/1008996950/nightforce-anti-cant-device-top-ring-bubble-level-for-nightforce-steel-unimount-and-direct-mount-rings-30mm-matte>].

(Continued)

*Primary Examiner* — Bret Hayes
(74) *Attorney, Agent, or Firm* — Jackson Walker, LLP

(57) ABSTRACT

The present disclosure provides an adjustable attachment system and method that can adjust for a variety of gaps between an accessory mounting system and a weapon mounting system, caused by tolerances in manufacturing. In at least one embodiment, a combination of keys can be provided with a first key having a thickness that is in a middle range of a predetermined tolerance, a second key having a greater thickness by a given percentage, and a third key having a lesser thickness by a given percentage. One or more of the keys can be coupled between surfaces of the accessory mounting system and the weapon mounting system, depending on the gap size. In another embodiment, at least one key can have a tapered lateral surface. The variable sized key can compensate for the variety of gaps by the lateral position of the key in the gap.

15 Claims, 7 Drawing Sheets

(56) References Cited

U.S. PATENT DOCUMENTS

| | | | | |
|---|---|---|---|---|
| 2012/0168589 | A1* | 7/2012 | Riley | F41G 11/003 248/315 |
| 2012/0227304 | A1* | 9/2012 | Engelhardt | F41G 11/003 42/90 |
| 2013/0000176 | A1* | 1/2013 | Goertzen | F41G 11/003 42/90 |
| 2013/0283663 | A1* | 10/2013 | Joplin | F41G 11/003 42/124 |
| 2016/0341522 | A1* | 11/2016 | Davis | F41H 5/12 |

OTHER PUBLICATIONS

Nightforce B.E.A,S.T. 5-25X56 f1 [retrieved from Internet on Jun. 23, 2017 using <URL: http://nightforceoptics.com/beast.

* cited by examiner

ADJUSTABLE ATTACHMENT SYSTEM FOR WEAPON ACCESSORIES

CROSS REFERENCE TO RELATED APPLICATIONS

This application claims the benefit of U.S. Provisional Patent Application No. 62/275,553, filed Jan. 6, 2016, which is incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

This disclosure relates a system and method for attaching weapon accessories to a weapon. More specifically, the disclosure relates to a system and method for attaching weapon accessories to a weapon for precision attachment accounting for manufacturing tolerances.

Description of the Related Art

Weapons, such as firearms, hunting bows, and other types of weapons, are commonly equipped with any number and type of accessories. Common accessories include a range finder, scope, anti-cant assembly, extended Picatinny rail mount, vertical "tool" or "pistol grips" bipods, light or a laser pointer, and others. Manufacturers typically provide standardized mounting systems on a weapon and corresponding mounting systems for accessories to facilitate the mounting of the wide variety of accessories. A weapon mounting system in the form of a rail that the US Government standardized for the military is known as a Picatinny rail, and has become widely popular in the commercial market as well. FIG. 1 is a schematic perspective view of an exemplary mounting system for a weapon. FIG. 2A is a schematic end view of military standardized manufacturing requirements with tolerances of a Picatinny rail, as the exemplary mounting system shown in FIG. 1. FIG. 2B is a schematic side view of the Picatinny rail of FIG. 2A. A Weaver rail system is similar with slightly smaller grooves. Other weapon mounting systems are commercially available and the above examples are not limiting.

The weapon 2 can have a mounting system 4, such as a Picatinny rail, mounted at some location on the weapon. The weapon mounting system 4 serves as a common base to mount the accessories with a corresponding accessory mounting system. In this example, the weapon mounting system 4 includes a tapered side 6 for a lateral clamp to wedge against and maintain lateral stability. A series of grooves 8A and 8B (generally, grooves 8) ideally provide longitudinally stability. However, in actuality, the manufacturing tolerances provide some degree of longitudinal instability. Machining tolerances may lead in some instances to a sub-optimal gap that affects the fit between the rail of the exemplary weapon mounting system and the accessory mounting system. For instance, machining tolerances may provide for what appears to be an acceptable fit between the exemplary weapon mounting system and the accessory mounting system of a scope, but may actually allow for slip when the weapon is fired, causing a scope to shift on recoil. In the example shown in FIG. 2B, the military standard allows 0.008" (eight thousandths of an inch) tolerance in manufacturing the groove width. Recoil shoving the weapon backwards can cause the accessory to move slightly within the longitudinal tolerance. If the accessory is a scope or other aiming accessory, the change can affect the accuracy of successive shots, especially for long range targets, competitive sports, and other precision activities. Each groove can change and even if one manufacturer can hold tighter tolerances, another manufacturer may not hold the same tolerance, though they are both providing tolerances within the military requirements.

Therefore, there remains a need to provide an attachment system that can adjust for a variety of gaps caused by tolerances in the fit between a weapon mounting system and an accessory mounting system for more stably mounting an accessory to a weapon.

BRIEF SUMMARY OF THE INVENTION

The present disclosure provides an adjustable attachment system and method that can adjust for a variety of gaps between an accessory mounting system and a weapon mounting system, caused by tolerances in manufacturing. Exemplary weapons can be hunting bows, firearms, and other types of weapons. In at least one embodiment, a combination of keys can be provided with a first key having a thickness that is in a middle range of a predetermined tolerance, a second key having a greater thickness by a given percentage, and a third key having a lesser thickness by a given percentage. One or more of the keys can be coupled between surfaces of the accessory mounting system and the weapon mounting system, depending on the gap size. In another embodiment, at least one key can have a tapered lateral surface. The variable sized key can compensate for the variety of gaps by the lateral position of the key in the gap. The adjustable attachment system allows for more precise adjustment of an interface and may result in more accurate positioning and/or stability of accessories on a weapon.

The disclosure provides a system for attaching an accessory to a weapon mounting system, comprising: an accessory mounting system comprising a lower body configured to be coupled to the weapon mounting system; and an adjustable attachment system comprising at least one key configured to be disposed between a surface of the lower body and the weapon mounting system, the key having a thickness to lessen a gap caused by a tolerance in manufacturing the weapon mounting system.

The disclosure also provides a ring of an accessory mounting system for an accessory, comprising: an upper ring assembly; and a lower ring assembly, the lower ring assembly comprising: an attachment mechanism configured to fixedly couple the lower ring assembly to the upper ring assembly to form a ring; a rail interface configured to fixedly couple the lower assembly to a rail of a weapon, wherein the rail interface includes a rail-facing surface; and a key configured to be disposed between the rail-facing surface of the lower assembly and the rail of the weapon.

The disclosure further provides a rail interface mechanism, comprising: a Picatinny rail interface configured to couple to a Picatinny rail, wherein the Picatinny rail interface comprises: a rail-facing surface; a key configured to be coupled to the rail-facing surface of the Picatinny rail interface; and a key attachment system configured to couple the key to the rail-facing surface of the Picatinny rail interface.

DETAILED DESCRIPTION

The Figures described above and the written description of exemplary structures and functions below are not presented to limit the scope of what the inventors have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and like terms are used in the written description for clarity in specific reference to the Figures and are not intended to limit the scope of the invention or the appended claims. For ease of cross reference among the Figures, elements are labeled in various Figures even though the actual textual description of a given element may be detailed in some other Figure.

The present disclosure provides an adjustable attachment system and method that can adjust for a variety of gaps between an accessory mounting system and a weapon mounting system, caused by tolerances in manufacturing. In at least one embodiment, a combination of keys can be provided with a first key having a thickness that is in a middle range of a predetermined tolerance, a second key having a greater thickness by a given percentage, and a third key having a lesser thickness by a given percentage. One or more of the keys can be coupled between surfaces of the accessory mounting system and the weapon mounting system, depending on the gap size. In another embodiment, at least one key can have a tapered lateral surface. The variable sized key can compensate for the variety of gaps by the lateral position of the key in the gap.

Figure 2A:
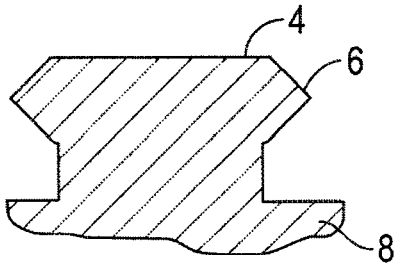
FIG. 2A (Prior Art)
FIG. 2A is a schematic end view of military standardized manufacturing requirements with tolerances of a Picatinny rail, as the exemplary mounting system shown in FIG. 1.
Figure 2B:
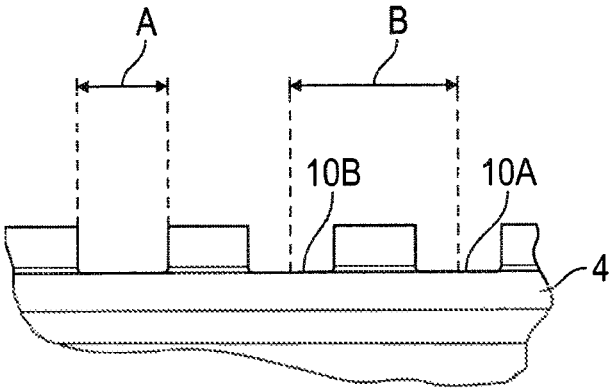
FIG. 2B (Prior Art)
FIG. 2B is a schematic side view of the Picatinny rail of FIG. 2A.
Figure 3A:
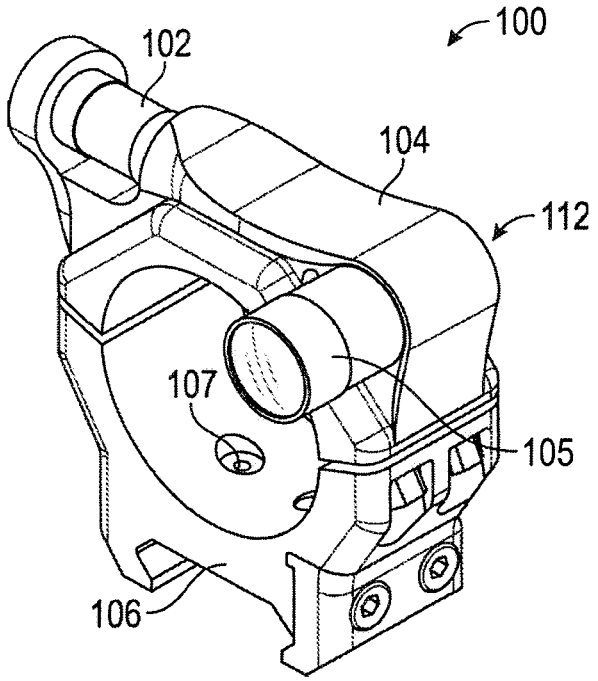
FIG. 3A is a schematic perspective view of an exemplary accessory mounting system compatible with an adjustable attachment system for the weapon mounting system illustrated in FIGS. 2A and 2B, according to the invention.
Figure 3B:
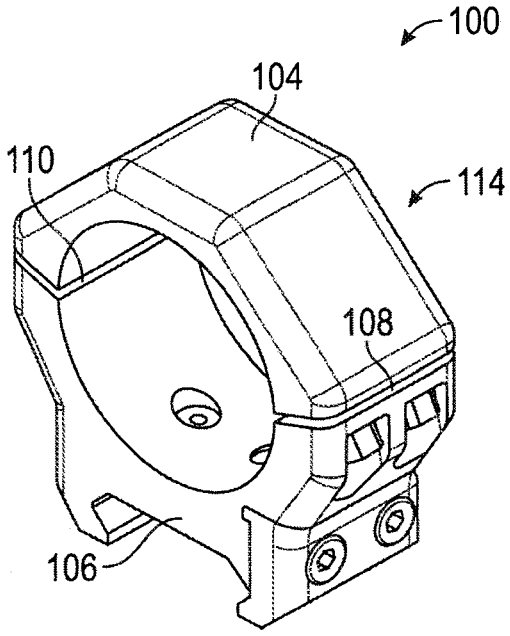
FIG. 3B is a schematic perspective view of the exemplary accessory mounting system of FIG. 3A.

FIG. 3A is a schematic perspective view of an exemplary accessory mounting system compatible with an adjustable attachment system for the weapon mounting system illustrated in FIGS. 2A and 2B, according to the invention. FIG. 3B is a schematic perspective view of the exemplary accessory mounting system of FIG. 3A. In some embodiments, the exemplary accessory mounting system 100 can include a first portion 112 and a second portion 114. In the illustrated embodiment of FIGS. 3A and 3B, the first portion 112 can be in the form of a rear clamp, and the second portion 114 can be in the form of a front clamp, although other configurations of an accessory mounting system 100 are also contemplated. The first and second portions can be for coupling an accessory, such as a scope or light, to a weapon mounting system 4, such as the rail illustrated in FIGS. 2A and 2B.

The accessory mounting system 100 can include a level device 102, upper body 104, light source 105, and lower body 106. The upper body 104 and the lower body 106 can be configured to be attached with the accessory therebetween, such as a scope, light, or other accessory. Other types of mounting systems 100 that are compatible with the weapon mounting system 4 are available. The accessory mounting system 100 can be configured to attach a key to a rail-facing surface, such as an underside, of the lower body 106 of the accessory mounting system 100. The light source 105 can illuminate the level device 102, elevation adjustment interfaces and windage adjustment interfaces (not shown), or other features of the accessory mounting system or accessory.

The accessory mounting system 100 can be configured such that the upper body 104 and the lower body 106 are attached at planes 108 and 110 or other surfaces. The attachment surface may be arranged in other relationships.

The upper and lower bodies can be configured such that the planes 108 and 110 are coplanar or not coplanar. For example, in the illustrated embodiment, plane 108 is not coplanar with plane 110. Plane 108 and plane 110 are set at different angles such that the upper body 104 is cupped in the lower body by the tapers of the planes. Other angular arrangements are contemplated.

Figure 4:
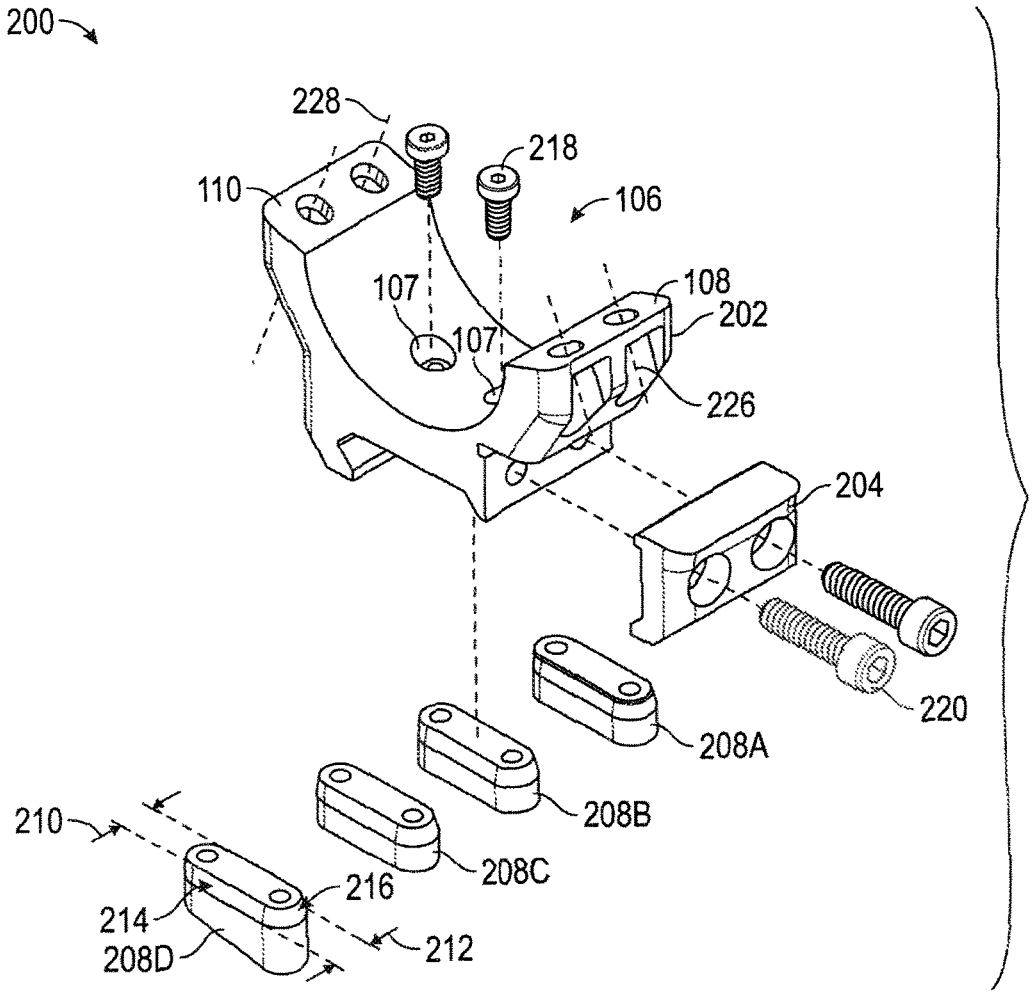
FIG. 4 is a schematic assembly view of a lower body of the accessory mounting system assembly and components of the adjustable attachment system.

FIG. 4 is a schematic assembly view of a lower body of the accessory mounting system assembly and components of the adjustable attachment system. In the illustrated embodiment, the lower body 106 is illustrated with mounting openings 107 to mount one or more components of the adjustable attachment system with the lower body. The openings 107 can be specifically configured based on the type of fasteners used to couple components of the adjustable attachment system to the accessory mounting system, such as the lower body 106. For example, the openings may be threaded, recessed, or angled. The lower body 106 is illustrated with mounting openings 220 oriented on arms 202 of the lower body depicted with axes 228 and 226 at respective planes 108 and 110. The lower body 106 may be configured with the axis of the various openings in parallel, offset, and/or at various angles to one another or with respect to the lower body. One or more fasteners 218, such as screws, rivets, or other fasteners, can be used to mount the upper body 104 with the lower body 106. Configuring the openings with an angular relationship to the body may facilitate incorporation of various additional assemblies into the upper body, such as an anti-cant device, laser, and so forth. Such configuration may also facilitate a more narrow body configuration. The lower body 106 is depicted with a detachable lateral clamp 204 that can be fastened to the lower body 106 via fasteners 220. The lateral clamp 204 may assist in fastening the lower body 106 to the weapon mounting system 4, such as the tapered side 6.

A plurality of keys 208A-208D (generally "208"), as components for the adjustable attachment system 200, can interface with a corresponding surface on either the accessory mounting system and/or weapon mounting system for coupling the one or more of the keys. The one or more keys can be coupled with fasteners 218, such as coupled to the lower body 106 in this embodiment. The illustrated keys may vary in configuration. The term "keys" is used broadly to include fixed or variable thickness structure and mechanism, including but not limited to square and rectangular keys, shims, circular and elliptical pins, screws and bolts, including those have variable thicknesses along a length.

In at least one embodiment, the thicknesses of a plurality of keys 208 may vary in a set, such that a key is selected from a plurality of keys with a particular thickness in attaching the accessory mounting system with the exemplary weapon mounting system, such as the illustrated rail. In some embodiments, the key 208 may take alternative shapes, such as the tapered shape illustrated by key 208D. The key 208D is illustrated with a dimension 210 that is different from dimension 212, illustrating a tapered shape laterally along the key, such as end-to-end. Other configurations are contemplated, for example, the tapered shape may be front-to-back. In some embodiments, the keys may have one or more shaped surfaces 214 and 216 that align with one or more shaped surfaces of the lower body 106.

In at one embodiment, a plurality of keys 208 form components of the adjustable attachment system 200 to interface with a corresponding surface on the accessory mounting system 100, the weapon mounting system 4, or a combination thereof. A first key thickness can be sized generally in a middle range of a given tolerance. The first key thickness could be sized to a selected value within a given range of the calculated mean value of the specified design dimension when adjusted for the high and low tolerance, where the range can be between 0% to plus or minus inclusive, and any incremental value therebetween, including decimals of such percentages, such as percentages of 1, 2, 3, 0.1, 0.2, 1.1, 1.2, 0.11, 0.12, and so forth. For clarification, this range is not a tolerance for manufacturing, but a range for selection of a thickness to make the first key. In the illustration of a Picatinny rail mounting system of FIG. 2B, the specification requires a groove dimension of 0.206 inches with a tolerance of +0.008 inches, so that the groove acceptable thickness is from 0.206 to 0.214 inches with a mean value of 0.210. Similarly, the mean value of the tolerance is 0.004 inches, so the thickness of the first key in this nonlimiting example would be adjusted from 0.206 inches as a nominal design dimension plus 0.004 inches as the mean average tolerance to yield a selected mean average thickness for the first key of 0.210 inches thick, if 0% is selected for the thickness. If the first key size was selected at the lower end of the exemplary 20% range, then the first key would be 0.2074 inches thick. If the first key size was selected at the higher end of the exemplary 20% range, then the first key would be 0.2116.

Once the size for the thickness of the first key is determined, than at least two other keys can be sized for the plurality of keys 208 of the adjustable attachment system 200, so that a second key thickness is greater than the first key thickness by a given percentage and a third key thickness is lesser than the first key thickness by a given percentage. Generally, the given percentages will be the same absolute value (plus or minus) of the first key thickness, but the percentages can vary from the first key. The second key can have the same or different percentage thickness relative to the first key when compared to the third key thickness. The thicknesses of the second and third keys can be sized relative to the first key within a range of plus or minus inclusive. If the percentage of difference from the first key to the second and third keys was chosen as some uniform percentage value, such as plus or minus 1.67% of the first key, then using the first key thickness of 0.210 as calculated above, the plus or minus value would be about 0.0035 difference from the first key thickness. Thus, the second key thickness would be 0.0035 greater than the first key thickness and the third key thickness would be 0.0035 less than the first key thickness. Further, fourth and fifth keys could similarly be created relative to the second and third keys, using the same or different percentages discussed above. The fourth key could be greater than the second key by some percentage of the second key, and the fifth key could be less than the third key by some percentage of the third kay. Further combinations are possible.

In some embodiments, the accessory mounting system may be arranged in relationship to one or more discontinuous portions of a weapon mounting system, such that different thickness keys may be used for different portions of the weapon mounting system.

Figure 5:
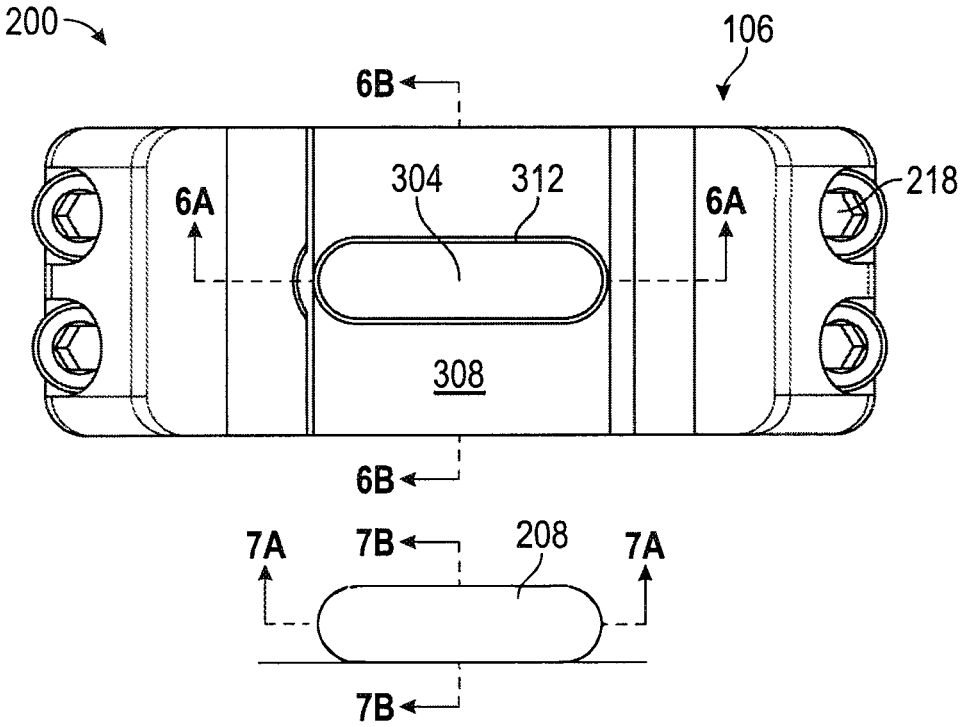
FIG. 5 is a schematic bottom view of the lower body of the accessory mounting system having a surface with a recess with an adjacent key of the adjustable attachment system of FIG. 4.

FIG. 5 is a schematic bottom view of the lower body of the accessory mounting system having a surface with a recess with an adjacent key of the adjustable attachment system of FIG. 4. The lower body 106 is depicted with a surface 308, such as a rail-facing surface that faces the surface of the weapon mounting system 4, such as a rail, when the accessory mounting system 100 is affixed to the weapon mounting system. In this exemplary embodiment, the surface 308 has been modified from a typical surface of a lower body to interface with the keys 208 described herein.

In the depicted embodiment, a recess 304 is formed to receive the key 208. In some embodiments, the recess 304 is in the form of a tapered seat 312. The recess 304 may be configured to make a friction fit with a key 208. It is also contemplated that the lower body 106 can be configured without a recess for interfacing with the key. The key 208 may be held in place by a compressive force between the lower body 106 and the weapon mounting system 4, by a friction fit between the lower body and the key, by fasteners, or otherwise, collectively herein a "key attachment system".

Figure 6A:
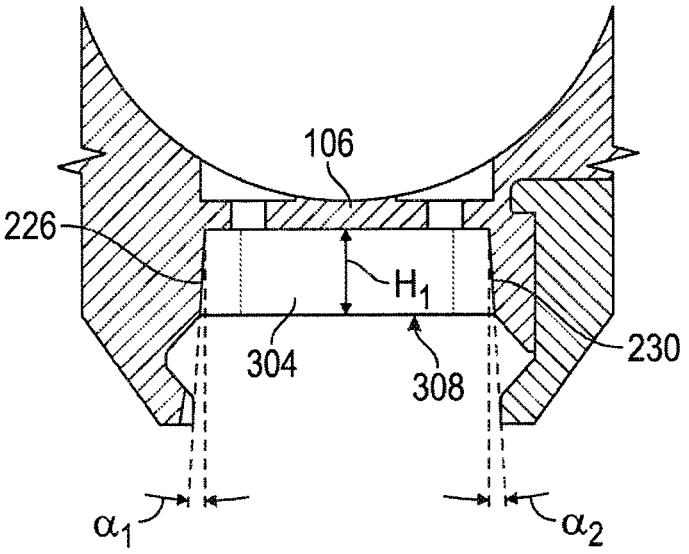
FIG. 6A is a schematic partial cross sectional view through a length of the recess in the lower body of FIGS. 4 and 5.
Figure 6B:
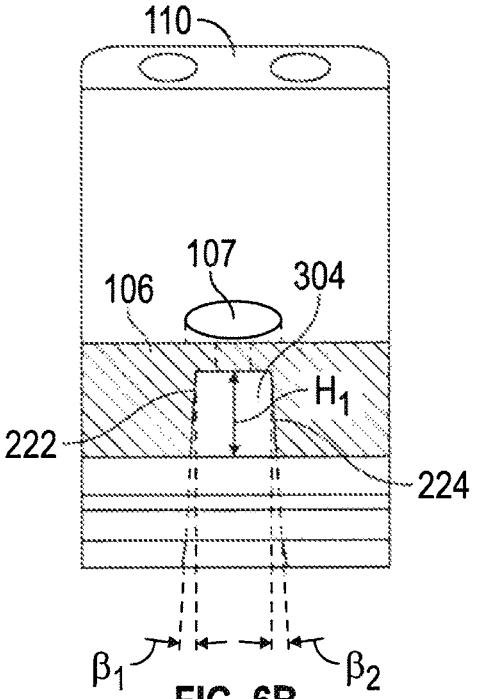
FIG. 6B is a schematic partial cross sectional view through a width of the recess of FIG. 6A.

FIG. 6A is a schematic partial cross sectional view through a length of the recess in the lower body of FIGS. 4 and 5. FIG. 6B is a schematic partial cross sectional view through a width of the recess of FIG. 6A. In the exemplary embodiment shown, the recess 304 is formed in the surface 308 of the lower body 106. The recess 304 can have one or more shaped surfaces in the ends and/or sides. In the exemplary embodiment, both sides and both ends of the recess have shaped surfaces. However, it is understood that variations are possible, such as one surface can be shaped and the opposite surface can be straight, one angle can be different from another angle, the recess angles can be different from the key angles described below, and other variations. The desired fit and interface between the recess 304 and the key 208 can influence the angles. For example, the recess 304 can have a first end angle "$\alpha$1" at a first end 226 and a second end angle "$\alpha$2" at a second end 230, opposite from the first end. The recess 304 can also include a first side angle "$\beta$1" at a first side 222 and a second side angle "$\beta$2" at a second side 224, opposite from the first side. The recess 304 can have a height H1.

Figure 7A:
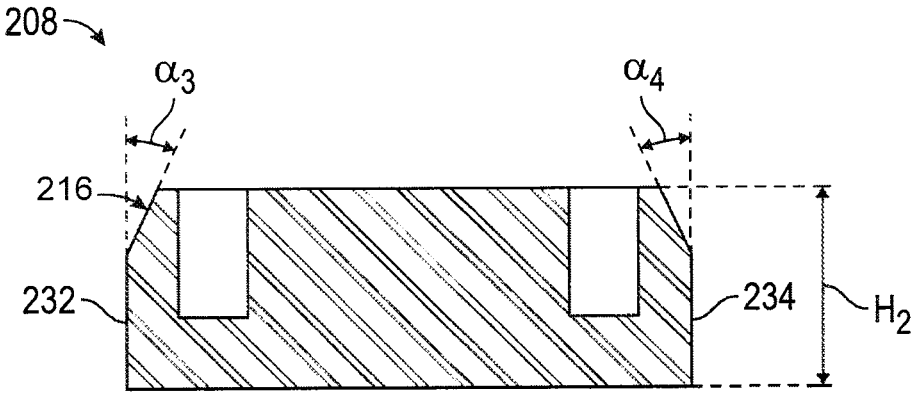
FIG. 7A is a schematic cross sectional view through a length of the key of FIGS. 4 and 5.
Figure 7B:
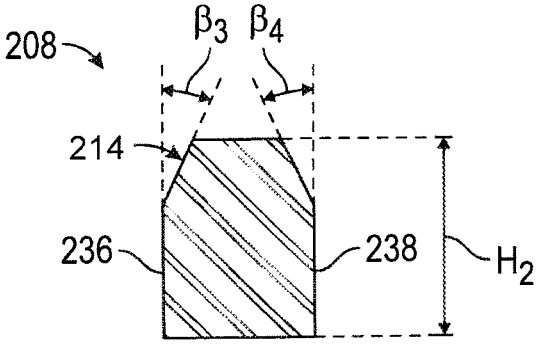
FIG. 7B is a schematic partial cross sectional view through a width of the key of FIG. 7A.

FIG. 7A is a schematic cross sectional view through a length of the key of FIGS. 4 and 5. FIG. 7B is a schematic partial cross sectional view through a width of the key of FIG. 7A. The key 208 can have one or more shaped surfaces on the ends and/or sides. In the exemplary embodiment, both sides and both ends of the key have shaped surfaces with the understanding that variations possible, such as one surface can be shaped and the opposite surface can be straight and other variations. For example, the key 208 can have a first end angle "$\alpha$3" at a first end 232 and a second end angle "$\alpha$4" at a second end 234, opposite from the first end. The key 208 can also include a first side angle "$\beta$3" at a first side 236 and a second side angle "$\beta$4" on a second side 238, opposite from the first side. The key 304 can have a height H2 that is generally less than the recess height H1.

Figure 8:
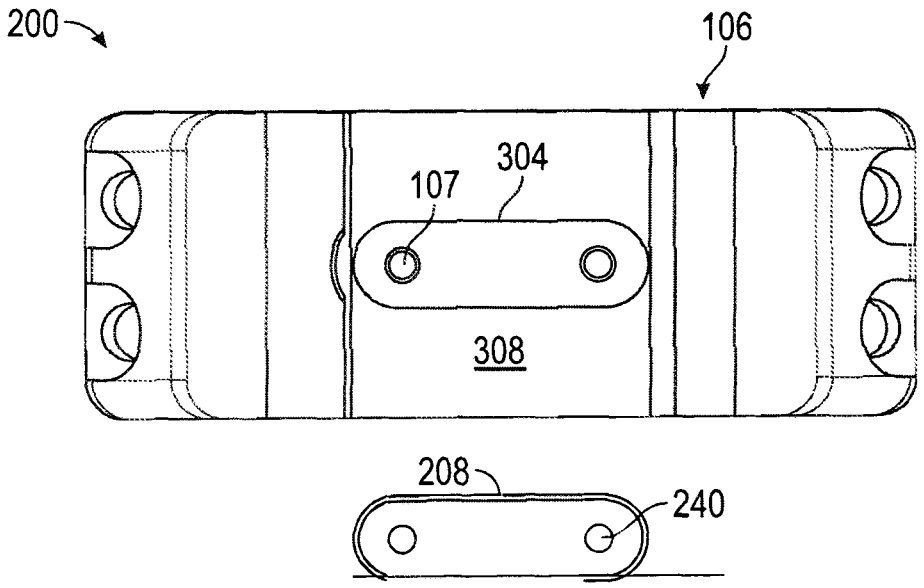
FIG. 8 is a schematic bottom view of an alternative lower body of an accessory mounting system with key of an adjustable attachment system.
Figure 9:
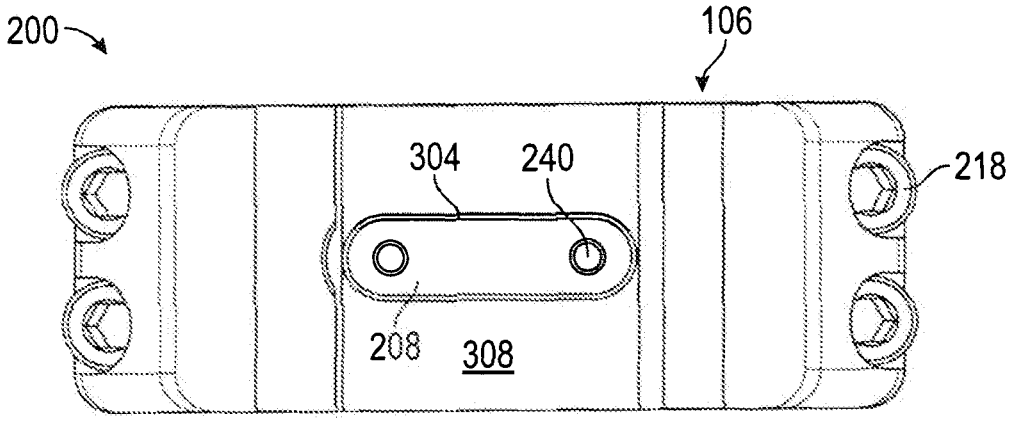
FIG. 9 is a schematic bottom view of the lower body of the accessory mounting system of FIG. 8 with the key of the adjustable attachment system inserted in the recess.

FIG. 8 is a schematic bottom view of an alternative lower body of an accessory mounting system with key of an adjustable attachment system. FIG. 9 is a schematic bottom view of the lower body of the accessory mounting system of FIG. 8 with the key of the adjustable attachment system inserted in the recess. In this embodiment, the lower body 106 has a surface 308, recess 304, and openings 107. In this embodiment, the lower body 106 is separate from the key 208 with key openings 222. In this embodiment, the key 208 can be coupled with the lower body 106 with the fasteners 218 through the openings 240.

Figure 1:
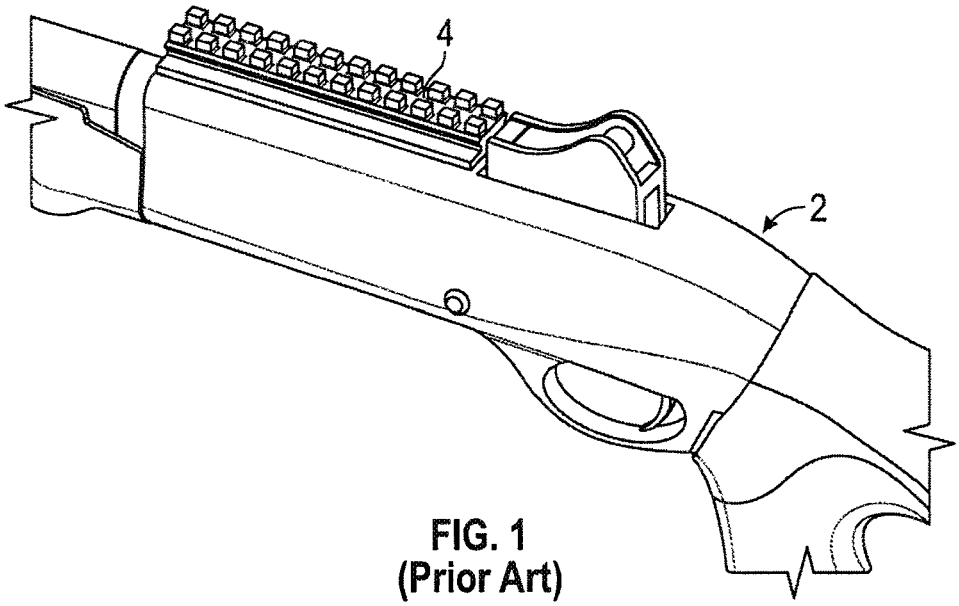
FIG. 1 (Prior Art)
FIG. 1 is a schematic perspective view of an exemplary mounting system for a weapon.
Figure 10:
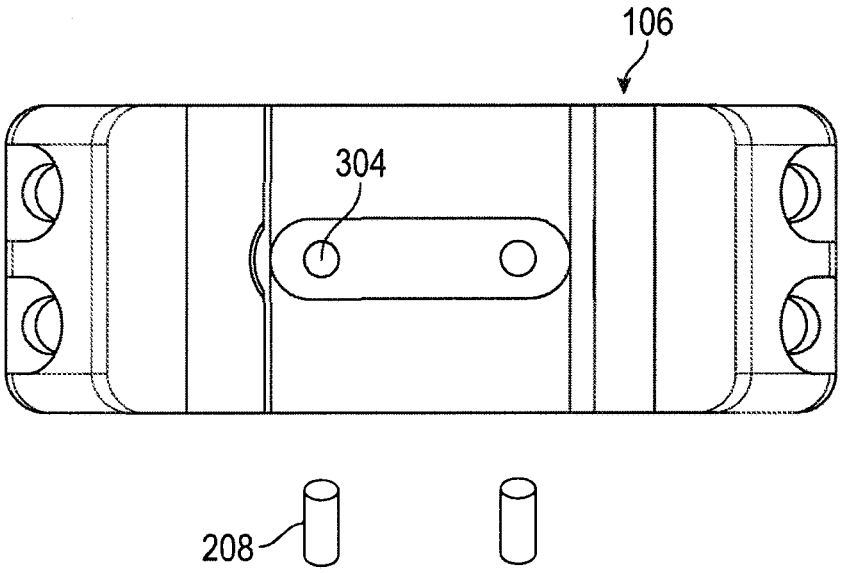
FIG. 10 is a schematic bottom view of an alternative lower body of an accessory mounting system with alternative key of an adjustable attachment system.

FIG. 10 is a schematic bottom view of an alternative lower body of an accessory mounting system with alternative key of an adjustable attachment system. As referenced herein, the key 208 can have a variety of shapes and sizes. As one other nonlimiting example, the key 208 can be a cylindrical shape such as a cylindrical pin, as well as elliptical and other shapes. The key 208 can be inserted into an appropriately shaped recess 304. Advantageously, one or more additional keys can be used to help stabilize the attachment of the lower body 106 to the mounting system 4, shown for example in FIG. 1. Further, as described herein a plurality of keys having different sizes can be used.

Figure 11:
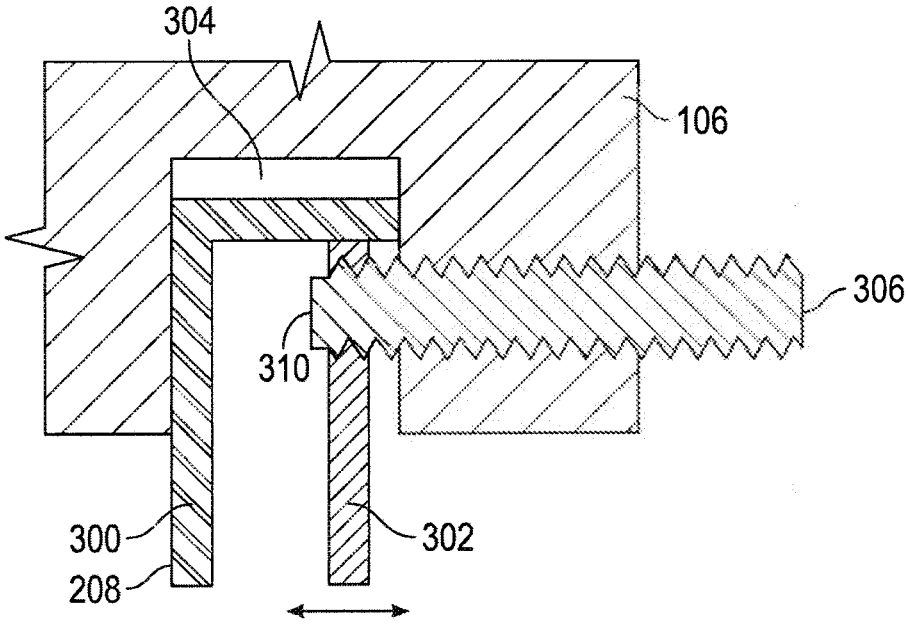
FIG. 11 is a schematic partial cross sectional view of a lower body with another embodiment of a key.

FIG. 11 is a schematic partial cross sectional view of a lower body with another embodiment of a key. In still another embodiment, the key 208 can be an adjustable key. The adjustable key 208 can be inserted into a recess 304 of a lower body 106. When attached to a mounting system 4, the thickness of the adjustable key 208 can be adjusted to more optimally fit the lower body 106 in conjunction with the mounting system 4. The adjustable key 208 can have a first leg 300 and an adjustable leg 302. An adjustor 306 can be rotatably engaged with the lower body 106 and coupled with the leg 302, such as with a retainer 310. As the adjustor 306 is rotated, it moves the adjustable leg 302 closer or apart from the first leg 300.

In some embodiments, components of the accessory mounting system are machined and anodized. In some embodiments, other surface finishes may be used. In some embodiments, components of the accessory mounting system may include counter bored openings that accept a fastener to couple the components together. For example, the lower body 106 is depicted with counter bored openings 107. In some embodiments, other types of openings and fasteners may be used.

Taken together, at least some of the exemplary embodiments describe a scope or light ring that includes an upper ring assembly, and a lower ring assembly that includes: an attachment mechanism configured to fixedly couple the lower ring assembly to the upper ring assembly to form a ring; a rail interface configured to fixedly couple the lower assembly to a rail of a weapon, wherein the rail interface includes a rail-facing surface; and a key configured to sit between the rail-facing surface of the lower assembly and the rail of the weapon.

In at least some embodiments, the key is configured to be semi-permanently affixed to the rail-facing surface of the lower assembly via a key attachment system. The key attachment mechanism may include one or more fasteners (such as screws, bolts, rivets, and so forth). The upper ring assembly may include one or more accessories (such as an anti-cant assembly, a Picatinny rail mount, a laser, or a light).

At least some of the embodiments describe a rail interface mechanism that includes a Picatinny rail interface configured to couple to a Picatinny rail, wherein the Picatinny rail interface includes: a rail-facing surface; and a key attachment system configured to semi-permanently attach a key to the rail-facing surface of the Picatinny rail interface.

In embodiments, the key may be configured to be semi-permanently affixed to the rail-facing surface of the Picatinny rail interface via the key attachment system. For instance, the attachment provided by a screw, bolt, rivet, or other fastener could semi-permanently attach the key. The key attachment system may include one or more threaded openings.

The rail interface mechanism may include an upper ring assembly and a lower ring assembly configured to be coupled via fasteners. The upper ring assembly may include one or more threaded openings with an axis that is not perpendicular to the rail-facing surface of the Picatinny rail interface. In some embodiments, the axis is not perpendicular to the rail-facing surface of the Picatinny rail interface.

The upper ring assembly and the lower ring assembly may be configured to be joined at two attachment points that each defines a plane between the upper ring and lower ring assemblies, and wherein the defined planes are not coplanar.

In some embodiments, the key attachment system is configured to attach keys of various thicknesses to the rail-facing surface of the Picatinny rail interface. The rail-facing surface may include a recess configured to accept the key.

Further, the various methods and embodiments of the system can be included in combination with each other to produce variations of the disclosed methods and embodiments. Discussion of singular elements can include plural elements and vice-versa. References to at least one item may include one or more items. In addition, various aspects of the embodiments could be used in conjunction with each other to accomplish the understood goals of the disclosure. Unless the context requires otherwise, the word "comprise" or variations such as "comprises" or "comprising" should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms such as "coupled", "coupling", "coupler", and like are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A system for attaching an accessory to a weapon mounting system, comprising:

an accessory mounting system comprising a lower body configured to be coupled to the weapon mounting system; and an adjustable attachment system comprising a plurality of keys configured to be disposed between a surface of the lower body and the weapon mounting system, the keys each having a thickness to lessen a gap caused by a tolerance in manufacturing the weapon mounting system, wherein the plurality of keys comprise:

a first key having a selected thickness within a range of a mean average of a specified dimension when adjusted for a high tolerance and a low tolerance;

a second key having a selected thickness at a predetermined value either greater than the first key thickness and equal to or less than the high tolerance or less than the first key thickness and equal to or greater than the low tolerance.

2. The system of claim 1, wherein the selected thickness at the predetermined value of the second key is greater than the first key thickness and equal to or less than the high tolerance; and further comprising a third key having a selected thickness at a predetermined value less than the first key thickness and equal to or greater than the low tolerance.

3. The system of claim 2, wherein the third key thickness is less than the first key thickness by a range between 1% to 5% inclusive.

4. The system of claim 1, wherein the first key thickness is selected between a range of 0% to an absolute value of 20% inclusive of the mean average.

5. The system of claim 1, wherein the second key thickness is greater than the first key thickness by a range between 1% to 5% inclusive.

6. The system of claim 1, wherein the thickness of at least one of the keys depends on a lateral position of the key along a lateral taper between the accessory mounting system and the weapon mounting system.

7. The system of claim 1, wherein the key thickness is adjustable.

8. A ring of an accessory mounting system for an accessory, comprising:

an upper ring assembly; and a lower ring assembly, comprising:

an attachment mechanism configured to fixedly couple the lower ring assembly to the upper ring assembly to form a ring;

a rail interface configured to fixedly couple the lower ring assembly to a rail of a weapon, wherein the rail interface includes a rail-facing surface; and a plurality of keys configured to be disposed between the rail-facing surface of the lower assembly and the rail of the weapon, each having a thickness to lessen a gap caused by a tolerance in manufacturing the weapon mounting system, wherein the plurality of keys comprise:

a first key having a selected thickness within a range of a mean average of a specified dimension when adjusted for a high tolerance and a low tolerance;

a second key having a selected thickness at a predetermined value either greater than the first key thickness and equal to or less than the high tolerance or less than the first key thickness and equal to or greater than the low tolerance.

9. The ring as recited in claim 8, further comprising an accessory is selected from a group that includes an anti-cant assembly, a Picatinny rail mount, a laser, a scope, or a light.

10. A rail interface mechanism, comprising:

a Picatinny rail interface configured to couple to a Picatinny rail, wherein the Picatinny rail interface comprises:

a rail-facing surface;

a plurality of keys configured to be coupled to the rail-facing surface of the Picatinny rail interface each having a thickness to lessen a gap caused by a tolerance in manufacturing the weapon mounting system, wherein the plurality of keys comprise:

a first key having a selected thickness within a range of a mean average of a specified dimension when adjusted for a high tolerance and a low tolerance;

a second key having a selected thickness at a predetermined value either greater than the first key thickness and equal to or less than the high tolerance or less than the first key thickness and equal to or greater than the low tolerance; and a key attachment system configured to couple the key-keys to the rail-facing surface of the Picatinny rail interface.

11. The rail interface mechanism as recited in claim 10, wherein the key attachment system is configured to attach a key selected from a group of keys of various thickness to the rail-facing surface of the Picatinny rail interface.

12. The rail interface mechanism of claim 10, wherein the key is laterally tapered.

13. The rail interface mechanism as recited in claim 10, wherein the rail-facing surface includes a recess configured to accept the key.

14. The rail interface mechanism as recited in claim 10, wherein the rail interface mechanism further comprises an upper ring assembly and a lower ring assembly configured to be coupled together via fasteners, and wherein the upper ring assembly includes one or more openings for the fasteners with an axis that is not substantially perpendicular to the rail-facing surface of the Picatinny rail interface.

15. The rail interface mechanism as recited in claim 14, wherein the upper ring assembly and the lower ring assembly are configured to be joined at two attachment points that each defines a plane between the upper ring and lower ring assemblies, and wherein the defined planes are not coplanar.

* * * * *